United States Patent [19]

Weinzierl et al.

[11] 4,368,103

[45] Jan. 11, 1983

[54] COAL CARBONIZATION AND/OR GASIFICATION PLANT

[75] Inventors: Klaus Weinzierl, Dortmund; Kurt Tippmer, Recklinghausen, both of Fed. Rep. of Germany

[73] Assignees: Vereinigte Elektrizitats-Werke Westfalen AG; Firma Carl Still GmbH & Co. KG, both of Fed. Rep. of Germany

[21] Appl. No.: 144,017

[22] Filed: Apr. 28, 1980

[30] Foreign Application Priority Data

May 10, 1979 [DE] Fed. Rep. of Germany ..... 2918859

[51] Int. Cl.[3] ..... C10B 49/12; C10J 3/52; C10J 3/84; C10J 3/86

[52] U.S. Cl. ..... 202/99; 48/78; 60/39.12; 60/39.46 S; 202/106; 202/227; 202/228

[58] Field of Search ..... 48/203, 78, 147 R, 210; 201/31, 39; 202/106, 221, 228, 121, 99, 227; 55/82, 269, 319, 434; 60/39.12, 39.46 S

[56] References Cited

U.S. PATENT DOCUMENTS

| | | | |
|---|---|---|---|
| 1,180,792 | 4/1916 | Norrman | 60/39.46 S |
| 1,591,679 | 7/1926 | Hawley | 60/39.46 S |
| 1,729,217 | 9/1929 | Hufschmidt | 60/39.46 S |
| 1,911,501 | 5/1933 | Grady | 60/39.46 S |
| 2,275,394 | 3/1942 | Hardgrove | 60/39.46 S |
| 2,357,303 | 9/1944 | Kerr et al. | 60/39.46 S |
| 2,399,884 | 5/1946 | Noack | 60/39.46 S |
| 2,516,141 | 7/1950 | Newman et al. | 48/203 |
| 2,601,390 | 6/1952 | Hague | 60/39.46 S |
| 2,616,256 | 11/1952 | Davy et al. | 60/39.46 S |
| 2,851,346 | 9/1958 | Sprague | 48/203 |
| 3,868,817 | 3/1975 | Marion et al. | 60/39.12 |
| 4,288,979 | 9/1981 | Liljedahl et al. | 60/39.12 |

FOREIGN PATENT DOCUMENTS

| | | | |
|---|---|---|---|
| 2650512 | 5/1978 | Fed. Rep. of Germany | 55/82 |

*Primary Examiner*—Bradley Garris
*Attorney, Agent, or Firm*—McGlew and Tuttle

[57] ABSTRACT

An improved plant for coal carbonization or gasification of the type having a vessel with reaction compartment, at least one burner at the top of the reaction compartment for the partial combustion of finely-ground coal at a temperature above the ash-melting temperature to produce a product of gas, coke dust and slag or ashes, the compartment having a bottom opening for the discharge of gas-coke dust current from the compartment, and means for separating the product gas is disclosed. A lower chamber is in the vessel underneath the compartment adjacent to the opening. A heating surface in a vertical wall portion of the vessel surrounding the lower chamber, and a slag trap adapted to trap slag arranged in the bottom of the chamber is provided.

8 Claims, 4 Drawing Figures

COAL CARBONIZATION AND/OR GASIFICATION PLANT

FIELD AND BACKGROUND OF THE INVENTION

The invention relates to a plant for the coal carbonization, or gasification, or both, having at least one burner arranged at the top in a reaction chamber for the partial combustion of finely-ground coal above the ash-melting temperature, and a bottom discharge opening for the gas-coke dust current with following heat exchangers, as well as a separation plant for the gas and the solids.

Such a plant is described in U.S. Pat. No. 3,991,557. In this plant, finely-ground coal is prepared, if necessary, by oxidation with air at low temperature in order to reduce the caking, and blown into a reaction chamber where it is carbonized or gasified, or both, with air, with oxygen-enriched air, or with an oxygen-steam mixture. The resulting gas-coke-dust-slag- or ash mixture is withdrawn from the bottom end of the reaction chamber and fed first to a waste-heat boiler in order to use the heat contained in the gas-solid mixture to generate steam. Subsequently, the gas-solid mixture is fed to a cyclone in which the gas and solids are separated. The coke dust is fed to a storage bin and the gas is fed over a heat-exchanger to a gas-purifying plant to produce a purified product gas required in the reaction chamber.

Though the temperature in the reaction chamber should be above the ash- or slag-melting temperature, that is, above 1,500° C., it is an open question why this should be so. Furthermore, it cannot be seen how the ashes are separated from the coke dust. The steady and continuous outflow of the ashes raises, however, special technical problems, because the operation takes place in a temperature range in which the slag cakes on the walls of the reaction chamber, for example, or of the cooler, thereby reducing the free flow cross section and the heat transfer. The caking of the slag on the refractory lining is enhanced by chemical reactions with the slag components, primarily iron oxides. The refractory lining can thus be rapidly destroyed so that the plant must be shut down prematurely to replace the lining. Replacement of the lining, however, is only possible when the plant has cooled down sufficiently, and results in considerable labor and cost expenditures.

It is not known how the problems in the reaction chamber resulting from caking are to be solved in the known plant. Furthermore, the waste heat boiler is arranged behind the reaction chamber over a line for which considerable heat losses can be expected.

SUMMARY OF THE INVENTION

The invention is based upon the considerations that an economical carbonization or gasification should take place at high temperatures and that a major part of the process heat should be utilized in the plant without encountering difficulties by the slag or ashes formed, and that these difficulties are caused by the contact of the ashes or slag with the walls of the reaction compartment and the cooling surfaces.

In accordance with the invention, a plant is provided, so designed with regard to the burners of the reaction compartment or chamber and the cooling and guidance of the gas-solid current, that permits optimum operation over a long period of time, while avoiding the drawbacks of known plants set forth above.

The problems are solved primarily by providing a chamber, arranged underneath the reaction compartment, having heating surfaces arranged in the range of the vertical walls, and a slag trap underneath. Liquefaction of the coal ashes, agglomeration of liquid slag particles, and the outflow of liquid slag particles which reach the wall of the reaction chamber are unavoidable in the reaction chamber, due to the high temperatures prevailing there. It is possible, however, by means of the design of a transition from the reaction chamber to the heating surface chamber, according to the invention, to avoid contamination of the heating surfaces by preventing the originally liquid slag particles, on their downward path, from reaching the heating surfaces arranged in the range of the vertical walls. The gas-solid current is conducted down without deflection, and the agglomerated slag particles cool off to such an extent in the range of the heating surfaces that they attain substantially a solid state of aggregation and can be withdrawn without difficulties from a slag trap at the bottom end of the heating surface part.

Extensive deposits of the ashes are achieved by at least one deflection piece arranged between the bottom part of the heat surfaces, which are designed as radiation heating surfaces, and the slag trap and at least one adjoining gas-coke dust-guide zone extending substantially upward. Preferably, radiation heating surfaces are also provided in the deflection piece, while contact heating surfaces are arranged in the adjoining vertical gas-coke dust-guide zone. This permits a reduction of the temperature of the gas-coke dust-mixture to about 300° C.

In order to obtain a possibly high coal throughput, the plant can have at least two deflection pieces arranged symmetrically to the reactor and adjoining gas-coke dust-guide zones. In this case, there are either a large number of burners provided in the reaction chamber, or the reaction chamber is divided into several parallel compartments.

A high throughput can also be achieved by at least two symmetrically arranged units, each with a reaction chamber, a chamber with radiation heating surfaces, and a slag discharge, a deflection piece on each of these units, and a common gas-coke dust-guide zone connected with the deflection pieces. In either case, a star-shaped arrangement of several units is possible, that is, several units arranged at spaced peripheral intervals around a central radiation heating surface chamber.

It is very important that the slag or ashes molten in the reaction chamber do not cake on the walls. This can be achieved by providing the reaction chamber with a substantially cylindrical design having a ratio of height to diameter ranging from 2:1 to 3:1, and at least two burners, with oppositely directed spiral gas discharge jets, arranged at the head of the reaction chamber. In addition, a ratio of the reactor diameter to the burner outlet diameter of 5:1 to 2:1 is preferable. It is an advantage of the inventive arrangement that any radial components of the gas-solid current issuing from the burners cancel each other out, and therefore, an extremely small portion of the slag or ashes reaches the wall of the reaction chamber.

Some liquid particles of carbon-free slag combine at the walls of the reaction chamber and thereby form slag channels which extend downwardly on the reaction chamber wall. Since a heat transfer through the reaction chamber wall cannot be completely avoided, the liquid slag, particularly in the bottom part of the reaction chamber cools. The cooled slag becomes viscous and does not drip off with sufficient thinness from the bottom part of the reaction chamber. This raises the risk of clogging. The outlet of the reaction chamber and the transition to the following chamber with radiation heating surfaces shold therefore, be so designed that the thinness of the slag is maintained without having to expend heat for this purpose. This can be achieved by providing an outlet which is reduced from about a quarter to a third of the cross-section of the reaction chamber, and a conical transition between the reaction chamber and the outlet having an angle of about 20 degrees to 40 degrees. A preferred outlet has the form of a nozzle. In this nozzle, the velocity of the gas-solid current is increased, so that the heat transfer from the hot gas to the cool liquid slag in the critical bottom range of the reaction chamber increases, and the temperature of the slag rises, thereby causing it to drip off from the nozzle in thinly liquid form.

Another difficulty occurring in plants for coal carbonization or gasification is that the silicon dioxide of the slag is reduced to silicon monoxide, due to the reducing atmosphere in the reaction chamber. The silicon monoxide evaporates, and is deposited as a sublimate on the reaction chamber wall which is cooler than the gas-solid current. This can be successfully prevented by providing a cross-sectional ratio of the radiation heating surface chamber to the reaction chamber outlet ranging from 1.5:1 to 5:1, this cross section being determinant for the ratio in the case of a nozzle-shaped reaction chamber outlet.

If the length of the radiation heating surface is dimensioned, taking into account the above-mentioned cross sectional ratio, so that the residence time or stay period of the gas-solid current is one to two seconds, the slag particles strike the radiation heating surfaces with a temperature which is 200° to 300° C. below the caking temperature, and which makes caking impossible. These parameters also ensure that the gas-coke dust-current leaves in the radiation heating surface chamber with a temperature of 800° C. to 900° C. This temperature effectively prevents the caking of slag particles even in the following zones.

The slag particles arriving at the bottom end of the radiation heating surface chamber should be withdrawn from the slag trap with an as low as possible temperature. For this purpose, the slag trap is advantageously made in a conical form and surrounded with a cooler traversed by boiler feed water. The slag particles are thereby cooled, to a temperature of about 200° to 300° C., so that the separation of the coke dust particles, separated with the slag particles, is possible without any difficulties.

In order to recover a major portion of the process heat, the plant can have parallel-connected radiation heating surfaces, designed as radiation evaporators with inlets and outlets connected to a steam cylinder, parallel-connected contact heating surfaces arranged in series in the gas-coke dust-guide zone and connected with their inlets to the steam cylinder and designed as process steam and export steam superheater and connected with inlet and outlet to the steam cylinder, and another feed water preheater arranged in the gas-coke dust-current and connected with the steam cylinder. The size of these radiation heating- and contact-heating surfaces, as well as the throughput, can be so selected such that the temperature at the burners is about 1,400° to 1,600° C., such that the gas-coke dust current has a temperature of 800° to 900° C. at the exit of the radiation heating surface chamber, is cooled to about 300° C. by the contact heating surfaces after the convection evaporator, and finally attains in the feed water preheater a temperature of 150° C.

Furthermore, a gas-coke separating system and an ash-coke-separating system can be combined with a common storage bin or unit, into which the coke obtained in the ash-coke separating system is fed by means of a solid conveyor using an inert gas.

Accordingly, it is an object of the invention to provide an improved plant for coal carbonization or gasification, or both, of the type having a vessel with a reaction compartment, at least one burner at the top of the reaction compartment for the partial combustion of finely-ground coal at a temperature above the ash-melting temperature to produce a product of gas, coke dust and slag or ashes, the compartment having a bottom opening for the discharge of a gas-coke dust current from the compartment, and means for separating the product gas. In accordance with the invention, the improvement arrangement includes a lower chamber in the vessel underneath the compartment adjacent to the opening. A heating surface is provided in a vertical wall portion of the vessel surrounding the lower chamber, and a slag trap adapted to trap slag in the range in the bottom of the chamber. The heating surface is preferably a radiation heating surface and, even more preferably, is designed as an evaporator to produce a steam or steam and water mixture which is passed to a steam cylinder. In accordance with still another preferred embodiment of the invention, deflection means communicating with the chamber between a bottom part of the heating surface and the slag trap are provided for passing product gas and coke dust from said chamber. A variety of heat transfer arrangements in the deflection means is utilized to optimize process heat recovery.

It is a further object of the invention to provide an improved plant for coal carbonization or gasification, or both, which is a simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
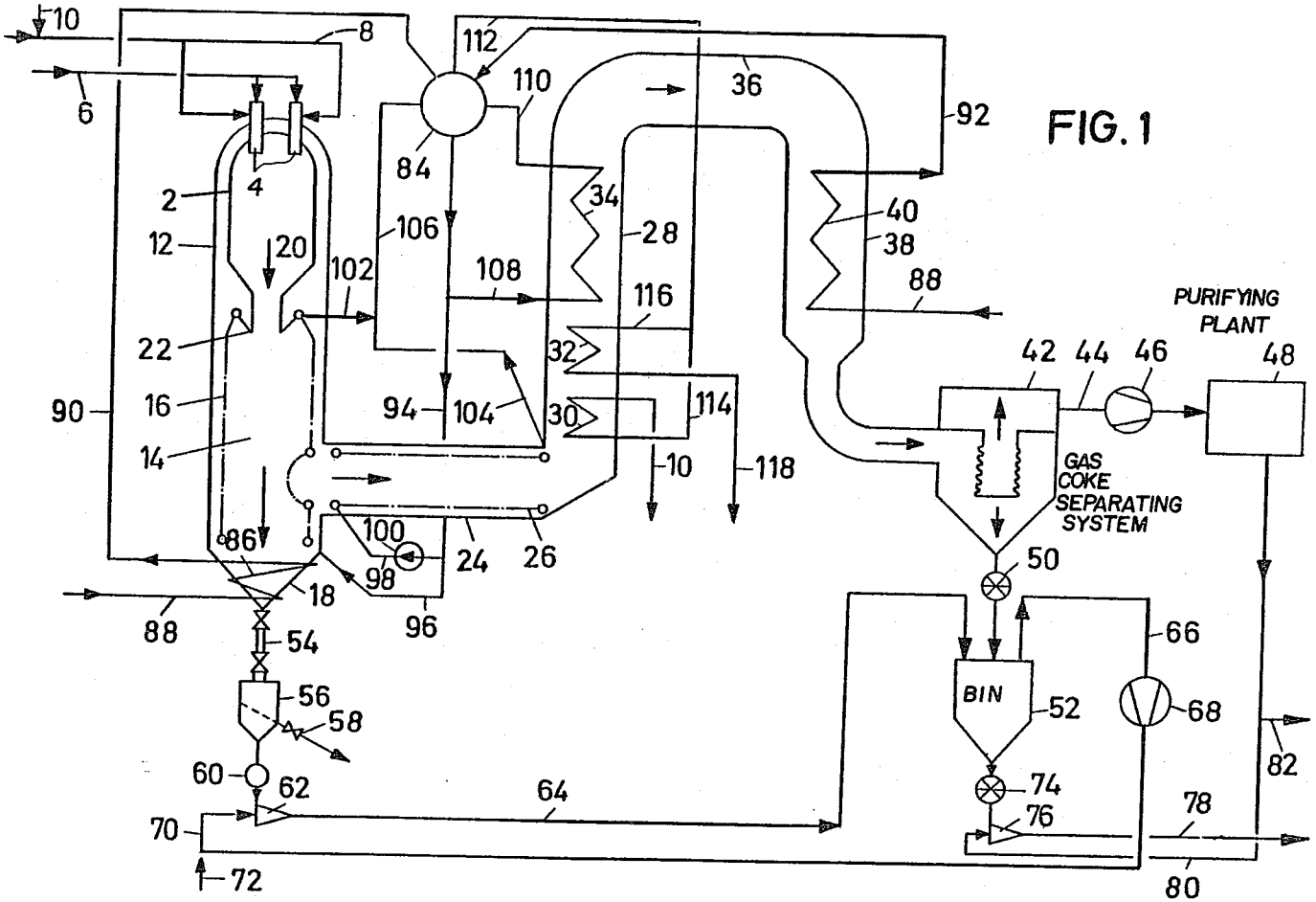
FIG. 1 shows a schematic view of a plant, according to the invention, without the part for oxidizing the coke dust and for preheating the reaction air.

Referring to the drawings, wherein like reference characters designate like or corresponding parts throughout the several views, preferred emobdiments of a plant according to the invention are illustrated in particular detail. FIG. 1 includes a vessel having a substantially cylindrical reaction compartment or chamber 2 lined with a known refractory lining (not shown). The reaction chamber 2 is provided, at its upper end, with burners 4 to which finely-ground coal and preheated conveyor air are fed through a line 6. If necessary, additionally required combustion air, as well as steam, from a process steam line 10, is fed through an additional line 8 to burners 4. A partial combustion, as well as a carbonization or gasification, or both, takes place in reaction chamber 2 at a temperature of 1400° to 1,600° C., and a product gas including methane, hydrogen, hydrogen sulfide, carbon monoxide and carbon dioxide are formed. Furthermore, coke dust and slag or ashes are likewise formed.

Reaction vessel or chamber 2 is provided at its bottom end with a conical transition 20 and a nozzle-shaped outlet 22. In outlet 22, the gas-coke dust current is so accelerated that the slag or ashes sticking to the walls of reaction chamber 2 are heated and thinned, so that the thinned liquid drips down from outlet 22.

Reaction chamber 2 is arranged in a substantially cylindrical body 12, and extends only over a small portion of its length. The other part of cylindrical body 12 contains a chamber 14 whose walls are designed as radiation heating surfaces 16. A cooled slag trap is arranged in the bottom part of cylindrical body 12.

At the bottom end of the radiation heating surfaces 16, just before slag trap 18, there is arranged a deflection piece 24 through which the gas-coke dust current leaves chamber 14. Due to the deflection extending over 90 to 135 degrees, the coarser slags and ashes are separated and arrive in slag trap 18. On the walls of deflection piece 24 are likewise provided radiation heating surfaces 26. A gas-coke dust-guide zone 28 is connected to and is disposed downstream of deflection piece 24 extending vertically upward. The contact heat transfer surfaces of a process steam superheater 30, of an export steam superheater 32, and of a convection evaporator 34 are arranged in zone 38.

Another deflection piece 36 connected to the outlet of zone 28, opens into a gas-coke dust-guide zone 38. In zone 38, which extends vertically downward, there are arranged the contact heat transfer surfaces of a feed water preheater 40. From here, the gas-coke dust mixture flows into a known gas-coke separating system 42. The gas is drawn from system 42 through a line 44 by means of a blower 46 and fed to a conventional gas purifying plant 48. The separated coke is withdrawn from the gas-coke separating system 42 over a sluice 50 and fed to a storage bin 52.

At the bottom end of slag trap 18, a sluice 54 is arranged through which the slag and the deposited coke dust is fed to a slag-coke separating system 56. A slag discharge 58 permits removal of the slag obtained, while the deposited coke dust is fed through a dosing sluice 60 to a solid conveyor 62, from where the coke dust is fed through a line 64 by means of an inert gas, e.g. nitrogen, to storage bin 52. The inert gas is drawn through a line 66 by a blower 68 from storage bin 52 and fed through a line 70 to a solid conveyor 62. Any inert gas losses can be replaced through a line 72.

The steam generating plant utilizing the process heat consists of a steam cylinder 84, which is connected through a line 90 to a feed water preheater 86 which is designed as a cooler for slag trap 18. An inlet pipe 88 to feed water preheater 86 is connected with a central feed water supply. The other feed water preheater 40, which is in the vertically downward extending gas-coke dust-guide zone 38 is connected through a line 92 with steam cylinder 84 and is likewise provided with an inlet pipe 88 which is connected to the central feed water supply.

A downcomer pipe 94 extends from steam cylinder 84 and branches into a line 96 to the radiation heating surface 16 designed as a radiation evaporator, and a line 98 to radiation heating surface 26 also designed as a radiation evaporator. In both lines 96, 98 or, as shown, in one of the lines, a forced feed pump 100 is provided to pump the boiler water arriving from steam cylinder 84 through radiation evaporators 16 and 26. The radiation evaporators 16, 26 have outlet pipes 102, 104 which are connected to an uptake line 106 through which the water-steam mixture passes into steam-cylinder 84. From downcomer pipe 94, a branch discharge line 108 leads to convection evaporator 34. A line 110 conducts the water-steam mixture produced in convection evaporator 34 into steam cylinder 84.

A saturated steam pipe 112 leads from steam cylinder 84 to a branch pipe 114 for process steam superheater 30 and a branch pipe 116 for export steam superheater 32. Superheater 30 feeds superheated process steam through line 10 to line 8 for combustion air. Export steam superheater 32 has an export steam pipe 118 from which steam can be withdrawn for other purposes, particularly for a turbogenerator.

The invention provides flow conditions in the reaction chamber and the adjoining chambers and pipes, where extremely little liquid slag strikes the reaction chamber walls, so that deposits and caking are avoided. The plant according to the invention also works satisfactorily with only one burner in the reaction chamber and is therefore not limited to the use of two burners with oppositely directed twist.

In the represented embodiment, a mixture of 13.5 metric ton per hour of finely ground coal and 4200 standard $m^3/h$ conveyor- or combustion air is fed at 300° C. through line 6 to reaction chamber 2 over burner 4. An additional 2,500 standard $m^3/h$ combustion air preheated to 700° C. is supplied through line 8. In addition, 550 kg/h moderator steam is introduced with a temperature of 700° C. through line 10 into line 8, whereby the reaction partners coal, air, dust and steam, introduced through burners 4 into reaction chamber 2 at temperatures between 1,400° and 1,600° C. and a pressure of 1.04 bar react with each other. A gas mixture containing carbon monoxide and hydrogen is formed in an amount of 50,000 standard $m^3/h$, as well as 5.3 metric ton per hour residual coke and slag. A quantity of 100 kg/h free slag are withdrawn through slag trap 18. Together with the 100 kg/h slag, a quantity of 1500 kg/h coke is withdrawn from slag trap 18, separated in the slag or ash-coke separating system 56 from the slag and fed by means of 200 standard $m^3/h$ inert gas by a solid conveyor 62 to storage bin 52. A flow rate of 2.55 standard $m^3/h$ feed water is fed through feed water preheater 86 to steam cylinder 84, while 35 metric ton per hour feed water is fed through feed water preheater 40. Process steam superheater 30 generates a feed 550 kg/h process steam with 700° C. to line 8, while export steam superheater 32 produces 37 g/h export steam with a temperature of over 450° C. and a pressure of 20 bar.

With the coke dust obtained in storage bin 52, it is possible to operate a conventional thermal power plant, while the purified gas is fed through line 82, for example, to a gas turbine, after which the exhaust gases of the gas turbine can be fed to the thermal power plant, using the coke dust from storage bin 52 as combustion air to carry out the known combination process.

Figure 2:
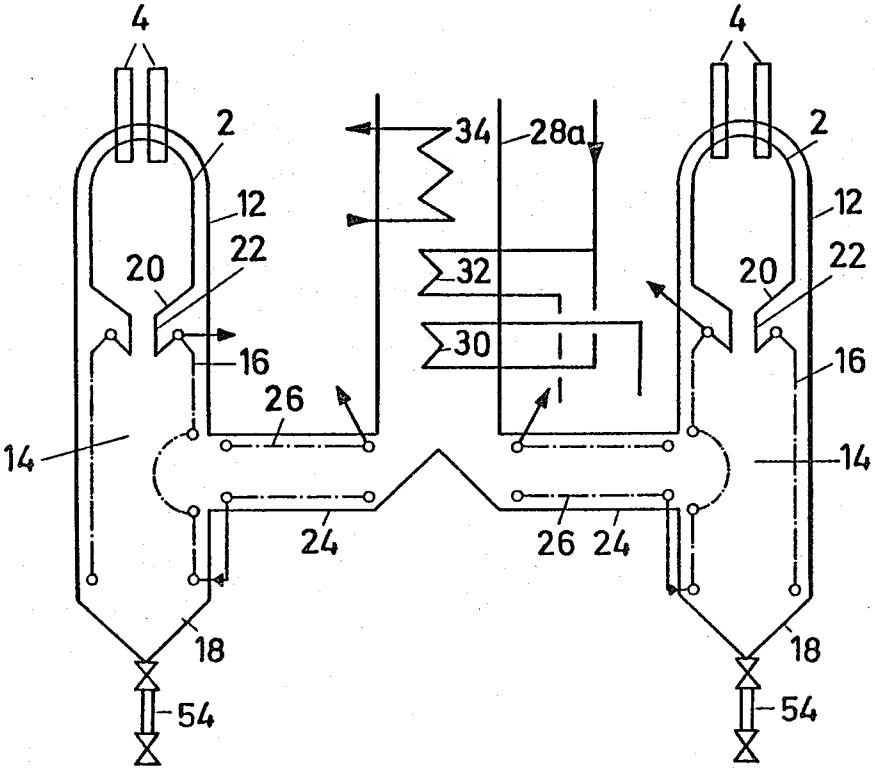
FIG. 2 shows a part of a plant, according to the invention, with reaction chambers arranged in satellite around a common gas-coke dust-guide zone.

FIG. 2 shows a part of a plant when a common vertical gas-coke dust-guide zone 28*a* is charged with the reaction products of several reaction chambers 2. This can lead to an increased output of a plant, according to the invention, and results in a particularly compact arrangement.

Figure 3:
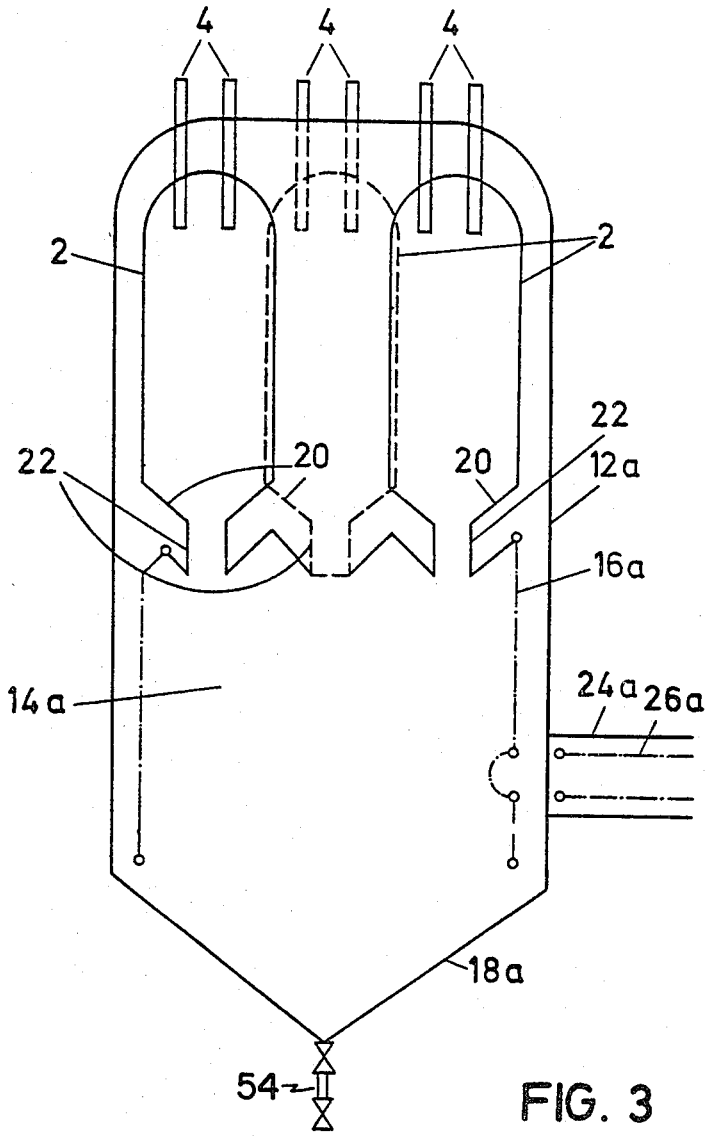
FIG. 3 shows a part of a plant, according to the invention, with plural parallel reaction chambers having openings into a common radiation heating surface.

The embodiment shown in FIG. 3 has several identical parallel reaction chambers 2 in a common cylindrical body 12*a*. The outlets 22 of reaction chambers 2 open into a chamber 14*a* with radiation heating surfaces 16*a*. The size of the radiation heating surfaces 16*a* and of chamber 14*a* is adapted to the increased gas-solid throughput, so that the parameters according to the invention are satisfied. A deflection piece 24*a* with radiation heating surfaces 26*a* is arranged in the same manner as in the embodiments according to FIGS. 1 and 2. A slag trap 18*a* forms the lower end of cylindrical body 12*a*, from which the slag is withdrawn through sluice 54.

In the embodiment of FIG. 3, deflection piece 24*a* is designed in the same manner as in the embodiments of FIGS. 1 and 2, and can lead in the same manner to a vertical gas-coke dust-guide zone 28 and 28*a*, respectively.

Figure 4:
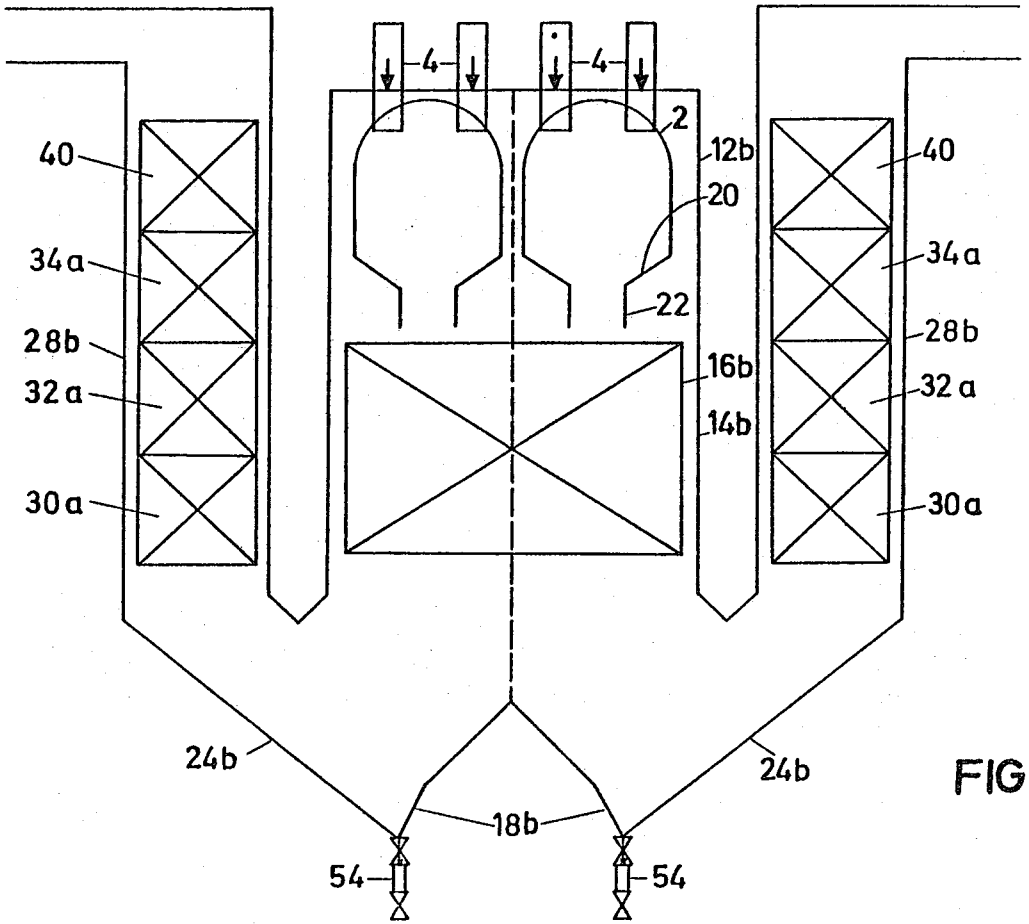
FIG. 4 shows part of a plant with a common, centrally arranged radiation heating surface chamber therearound at peripherally spaced intervals.

In the embodiment according to FIG. 4, a cylindrical body 12*b* is provided with at least two reaction chambers 2 with burners 4, whose outlets 22 open into a chamber 14*b* with radiation heating surfaces 16*b*. The lower end of cylindrical body 12*b* is divided into two deflection pieces 24*b*, which are not horizontal, as in the embodiment of FIGS. 1 to 3, but extend at first downward in an angle of 45° and are then deflected by 90°, to pass over upward in an angle of 45° with respect to the vertical into two vertical gas-coke dust-guide zones 28*b*. Due to the deflection by 90°, slag traps 18*b* are formed in the range of the bottom end of cylindrical body 12*b*, each of which is provided with a sluice 54 for removal of the slag.

It is not possible to arrange radiation heating surfaces in deflection pieces 24*b*, so that the radiation heating surfaces 16*b* are so dimensioned that the gas coke current is sufficiently cooled when entering deflection pieces 24*b*, to trap the slag in slag trap 18*b* without any difficulty. In the vertical gas-coke dust-guide zones 28*b* are arranged, as in the other embodiments, a process steam superheater 30*a*, an export steam superheater 32*a*, a convection evaporator 34*a*, and a feed water preheater 40, which are all equipped with contact heating surfaces.

While specific embodiments of the invention have been shown and described in detail to illustrate the application of the principles of the invention, it will be understood that the invention may be embodied otherwise without departing from such principles.

What is claimed is:

1. In a plant for coal carbonization or gasification, or both, of the type having a vessel with reaction compartment, at least one burner at the top of the reaction compartment for the partial combustion of finely-ground coal at a temperature above the ash-melting temperature to produce a product of gas, and solid components composed of coke dust and slag or ashes, the burner being operable to issue a current of the gas and solid components into the reaction compartment, the compartment having a bottom opening for the discharge of gas-coke dust from the compartment, and means for separating the product gas from the solid components, the improvement comprising said vessel having a lower chamber in said vessel underneath said compartment adjacent to the opening, said vessel having a vertical wall portion with a heating surface surrounding said lower chamber, wherein said heating surface is a radiation heating surface, and a slag trap adapted to trap slag arranged in the bottom of said chamber, an uncooled refractory lining said reaction compartment and wherein said reaction compartment is substantially cylindrical with a height-diameter ratio of 2:1 to 3:1 and at least two burners with oppositely directed spirals are arranged at the top of said reaction compartment, said burners being operative to pass the current of gas and solid components therefrom such that any radial components of the gas-solid current issuing from the burners cancel each other out, said heating surface being a radiation heating surface further comprising deflection means for passing product gas and coke dust from said chamber, said deflection means communicating with said chamber between a bottom part of said heating surface and said slag trap, a nozzle-shaped outlet member at said bottom opening, and a conical transition between said reaction compartment and the outlet member, having an angle of 20 to 40 degrees, the ratio of the cross-section of said chamber to the cross-section of the reaction compartment outlet ranging from 1.5:1 to 5:1, the ratio of the reaction compartment diameter to the burner outlet diameter ranging from 5-1 to 2-1, said bottom opening having a cross-section dimension of about a quarter to a third of the cross-section of the reaction compartment, and said compartment having a length sufficient to provide a residence time of the gas-solid current of one to two seconds.

2. An improved plant according to claim 1, wherein said deflection means includes a radiation heating surface.

3. An improved plant according to claim 1, wherein said deflection means includes a deflection member connected to said vessel in communication with said chamber, said deflection member having a radiation heating surface and a guide member extending substantially vertically upward communicating with said deflection member.

4. An improved plant according to claim 3, wherein said vessel includes at least two symmetrically arranged vessels, and a common gas-coke-dust guide member connected to and communicating with each deflection member.

5. An improved plant according to claim 1, wherein said deflection means includes at least two deflection members for passing gas and coke dust symmetrically communicating with said chamber and at least two gas-coke dust guide members, each communicating with a respective deflection member.

6. An improved plant according to claim 1, wherein at least two parallel reaction compartments open into said chamber.

7. An improved plant according to claim 1, further comprising cooler means for preheating boiler feed water disposed in said slag trap.

8. An improved plant according to claim 1, further comprising a steam cylinder, said heating surface including parallel-connected radiation heating surfaces, designed as radiation evaporators, having inlets and outlets connected to said steam cylinder, a plurality of parallel-connected contact heat exchanges serially arranged in said deflection means and communicating with said steam cylinder for superheating steam, a convection evaporator arranged downstream of said contact heat exchangers and having an inlet and outlet communicating with the steam cylinder, and a feed water preheater arranged downstream of said convection evaporator connected with the steam cylinder.

* * * * *